US006082870A

United States Patent [19]

George

[11] Patent Number: 6,082,870

[45] Date of Patent: Jul. 4, 2000

[54] TREAD AREA AND STEP EDGE LIGHTING SYSTEM

[76] Inventor: Ben George, 4640 E. La Palma Ave., Anaheim, Calif. 92807

[21] Appl. No.: 09/154,255

[22] Filed: Sep. 16, 1998

Related U.S. Application Data

[63] Continuation of application No. 08/756,160, Nov. 25, 1996.

[51] Int. Cl.[7] ..... F21S 4/00

[52] U.S. Cl. ..... 362/146; 364/240; 364/246; 364/249; 364/355; 364/800

[58] Field of Search ..... 362/145, 146, 362/153, 240, 244, 246, 249, 147, 355, 800

[56] References Cited

U.S. PATENT DOCUMENTS

| | | | |
|---|---|---|---|
| D. 311,588 | 10/1990 | Nagano . | |
| D. 312,135 | 11/1990 | Nagano . | |
| 3,500,036 | 3/1970 | Szentveri . | |
| 3,663,808 | 5/1972 | Baatz . | |
| 3,692,993 | 9/1972 | Robinson . | |
| 3,885,144 | 5/1975 | Lewis et al. . | |
| 4,143,411 | 3/1979 | Roberts . | |
| 4,271,458 | 6/1981 | George, Jr. . | |
| 4,337,759 | 7/1982 | Popovich et al. . | |
| 4,544,996 | 10/1985 | George . | |
| 4,600,975 | 7/1986 | Roberts | 362/147 |
| 4,612,606 | 9/1986 | Roberts . | |
| 4,625,266 | 11/1986 | Winter . | |
| 4,665,470 | 5/1987 | George, Jr. . | |
| 4,855,882 | 8/1989 | Boss . | |
| 4,907,361 | 3/1990 | Villard . | |
| 4,908,743 | 3/1990 | Miller . | |
| 4,943,900 | 7/1990 | Gartner . | |
| 4,945,675 | 8/1990 | Kendrick . | |
| 5,045,981 | 9/1991 | Nagano . | |
| 5,103,382 | 4/1992 | Kondo et al. . | |
| 5,222,799 | 6/1993 | Sears et al. . | |
| 5,343,375 | 8/1994 | Gross et al. | 362/240 |
| 5,404,869 | 4/1995 | Parkyn, Jr. et al. . | |
| 5,430,627 | 7/1995 | Nagano . | |
| 5,499,170 | 3/1996 | Gagne . | |
| 5,594,628 | 1/1997 | Reuter et al. . | |
| 5,607,227 | 3/1997 | Yasumoto et al. . | |

OTHER PUBLICATIONS

"Supper Flux LEDs"—Hewlett Packard catalog—pp. 1–25, 1–26.

"Escort Lights"—Tivoli –Aisle Lighting Systems, Extrusion, Tivoli Replacement Lamp System, Lens Cover. Brochure.

*Primary Examiner*—Alan Cariaso

*Attorney, Agent, or Firm*—Knobbe, Martens, Olson & Bear LLP

[57] ABSTRACT

A tread area and step edge illumination system is disclosed which comprises a base member configured for attachment to an exposed edge or surface of a step or stair. The base member has a downwardly projecting rearward wall and a forwardly and downwardly extending forward wall portion, a downwardly facing opening being defined between the rearward and forward walls. A light strip assembly having an elongate light strip with a number of longitudinally spaced-apart miniature lights, for example pre-focused LED's, mounted to the strip. The light strip assembly is detachably mounted to the base member so that light from the miniature lights on the light strip is directed downwardly through the downwardly facing opening when the lights are lit, the light strip assembly being mounted to the base member so that the light strip assembly can be selectively adjusted through an angle of about 60° to enable selective adjustment of the direction of light from the light strip assembly. A diffuser lens may be detachably mounted to the base member so that the lens is in the path of light from the light strip assembly when the lights are lit.

18 Claims, 2 Drawing Sheets

TREAD AREA AND STEP EDGE LIGHTING SYSTEM

This application is a continuation of Ser. No. 08/756,160 filed Nov. 25, 1996.

BACKGROUND OF THE INVENTION

1. Field of the Invention

The present invention relates generally to the field of apparatus or systems for lighting or illuminating steps or stairs, and more particularly to the field of apparatus or systems for illuminating the tread area and the edges of steps or stairs.

2. Background Discussion

It will be appreciated that there exists a necessity to light or illuminate the tread area and the edges of steps or stairs, especially in business establishments such as theaters and restaurants, where the steps or stairs may be in dark or dimly lighted areas.

Owners or operators of the business establishments that fail to provide adequate lighting at the edge of stairs or steps may be legally liable for substantial damages in the case of injury accidents to customers or patrons who misstep and fall because of losing their footing on dark or poorly lighted stairs or steps. If the business owners or operators were aware of a potentially dangerous lighting conditions for their stairs or steps, they may be subject to high punitive damages.

Homeowners may be equally liable to guests who fall as a result of unlit or poorly illuminated stairs, or steps in dark areas, such as in basements or attics.

It can further be appreciated that although edges of steps or stairs in dark areas, such as darkened theaters, need to be illuminated sufficiently, to avoid trips and falls of patrons, the illumination needs to be such that it is unobtrusive. That is, the lighting needs to perform its function without being unduly distracting.

It is the principal objective of the present invention to provide an improved tread area and step edge lighting system which satisfies the foregoing requirements.

SUMMARY OF THE INVENTION

In accordance with the present invention, there is provided a tread area and step edge illumination system which comprises a base member configured for attachment to an upper exposed edge of a step or stair, or the like, the base member having a downwardly projecting rearward wall and a forwardly and downwardly extending forward wall portion, a downwardly facing opening being defined between the rearward and forward walls.

Included is a light strip assembly having an elongate light strip with a number of longitudinally spaced-apart miniature Lights mounted to the strip, and means for detachably mounting the light strip assembly to the base member so that light from the miniature lights on the light strip is directed downwardly through the downward facing opening when the lights are lit. Preferably the lights are small, long-life pre-focused LED's.

In accordance with a preferred embodiment of the invention, the means for detachably mounting the light strip assembly in the base member enable angular adjustment of the light strip assembly through a preestablished angle, which is between 0° and about 60° so as to enable the selective direction of light from the light strip assembly through the preestablished angle.

The illuminating system preferably also includes a light diffusing lens and means for detachably mounting the lens to the base member so that the lens is in the path of emitted light from the light strip assembly when the lights are lit.

BRIEF DESCRIPTION OF THE DRAWINGS

The present invention can be more readily understood by a consideration of the following detailed description when taken in conjunction with the accompanying drawings, in which.

In the various FIGS., the same elements and features are given the same reference numbers.

DESCRIPTION OF THE PREFERRED EMBODIMENT

Figures 1, 2:
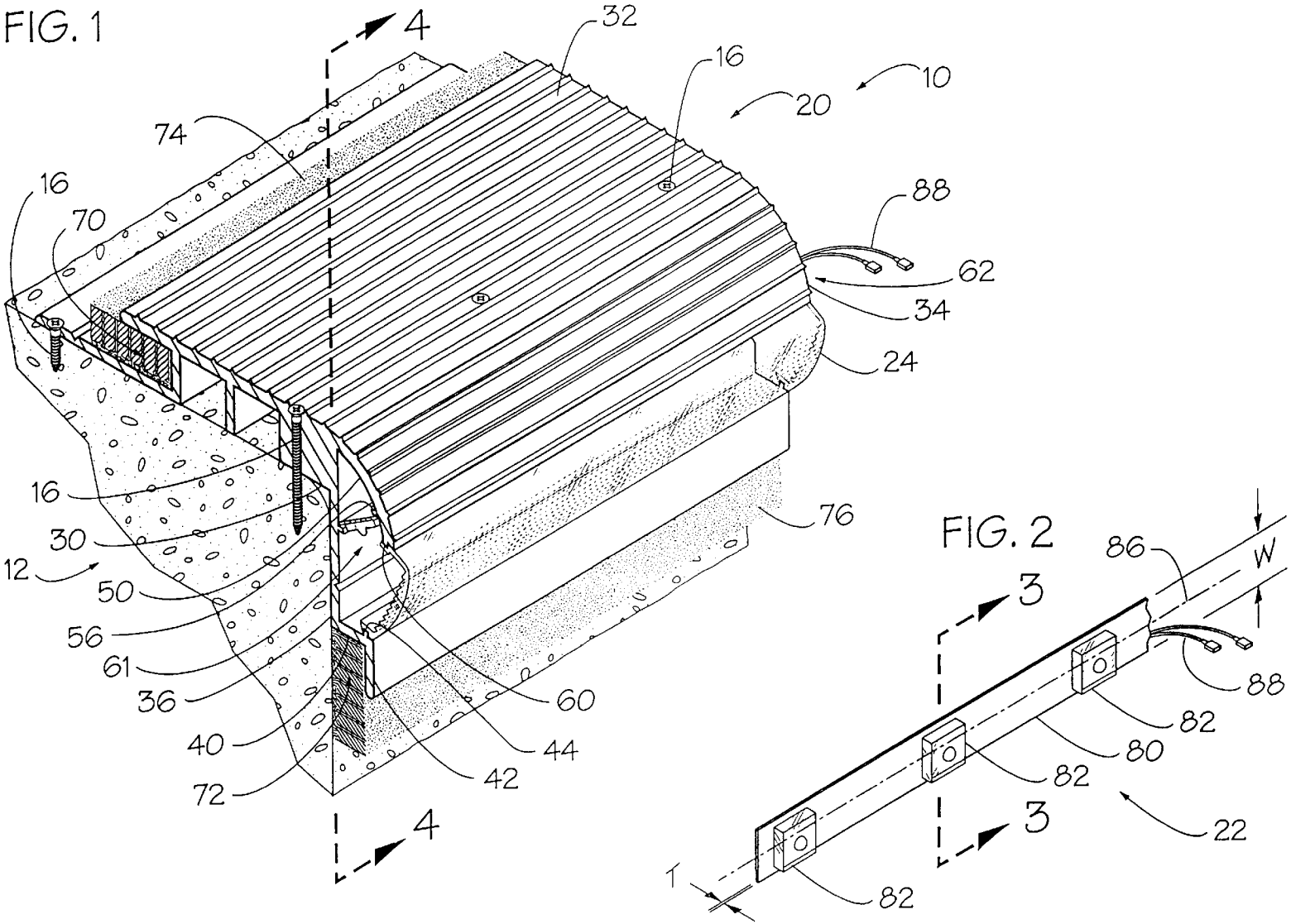
FIG. 1 is a perspective drawing of the step edge lighting system of the present invention showing a step edge base having installed therein an elongate lighting strip and an elongate lens, and showing the apparatus attached to a representative step edge.
FIG. 2 is a perspective drawing of the lighting strip of FIG. 1 showing the installation thereon of a plurality of longitudinally spaced apart lighting elements.

There is shown in FIG. 1 a step edge lighting apparatus or system 10 that is particularly adapted for lighting or illuminating the tread area of steps or stairs.

Step edge lighting system 10 is shown in FIG. 1 as being attached to an upper edge region 12 of a representative step or stair 14, for example by screws 16, for purposes of describing the invention. It will, however, be appreciated that step edge lighting system is not limited thereto, and can also be used to advantage to illuminate edge regions of such other objects or structures as platforms or patios, roof or rafter edges or exposed edges of decorative planters.

Figure 3:
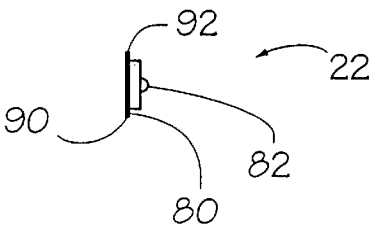
FIG. 3 is a transverse cross sectional drawing taken along line 3—3 of FIG. 2, showing one of the lighting elements.
Figure 4B:
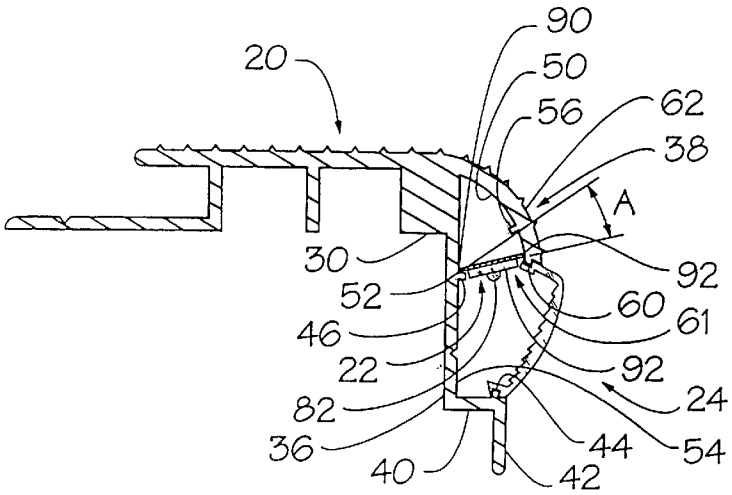
FIG. 4 is a transverse cross sectional drawing taken along line 4—4 of FIG. 1, FIG. 4A showing a first position of the lighting strip for providing a generally downwardly directed light and FIG. 4B showing a second position of the lighting strip for providing a light that is generally directed downwardly and forwardly.
Figure 5:
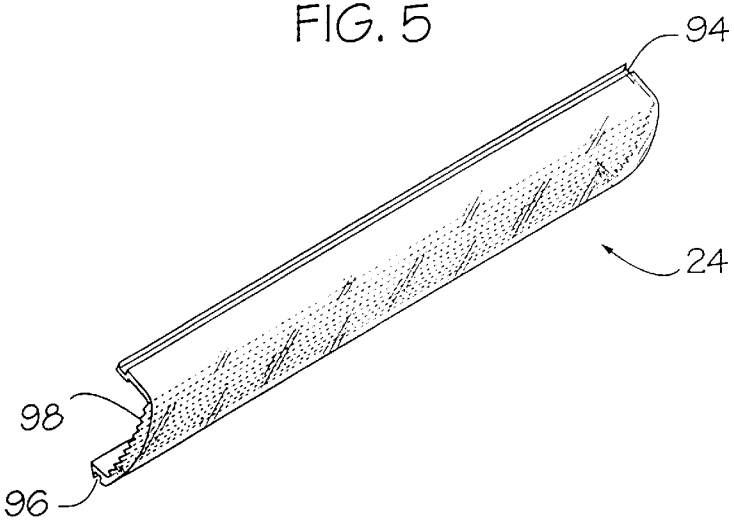
FIG. 5 is a perspective drawing of the lens showing its general construction.

Comprising generally step edge lighting system 10 are a base member or portion 20 (FIGS. 1 and 4), an elongate light strip assembly 22 (FIGS. 1–3) and an elongate lens 24 (FIGS. 1, 4 and 5).

Base portion 20 comprises an elongate structure formed having a 90 degree inner corner region 30 (FIG. 1) which enables the base portion to fit closely around upper forward step corner region 12.

Further forming base portion 20 are a flat upper surface portion 32 and a depending forward nose portion 34, the latter of which comprises a depending, rearward wall or leg 36 and a forwardly and downwardly arched front wall 38. Extending forwardly from the bottom of rearward leg 36 is a short flange 40 that has, at its free, forward end a short depending flange 42 and a shorter, upwardly projecting, longitudinally-extending lens-mounting rib 44 that is set slightly rearwardly of flange 42 (best seen in FIG. 4A).

A short, longitudinally-extending light strip retaining rib 46 projects forwardly from rearward leg 46 somewhat more than halfway up from the lower end of the leg. Forward wall 38 is constructed so that an inner surface 50 thereof is at a constant radius, R, from an upper intersection line 52 of rib 46 and lower regions of an inner surface 54 of rearward wall 36.

Figure 4A:
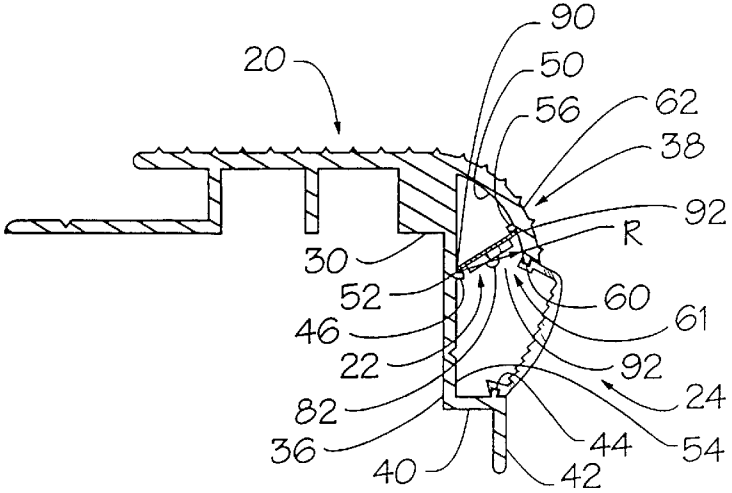

A short, longitudinally-extending light strip retaining rib 56 projects rearwardly from inner surface 50 of forward wall 38 near a lower, free end 60 thereof (FIGS. 4A and 4B). A downward facing opening 61 is defined between rearward wall 36 and forward wall 38 at lower end 60 thereof (FIG. 4A).

A forward surface 62 of forward wall 38 may, as shown in FIGS. 1 and 4A and 4B), be sculptured with plurality of ridges as shown or may be smooth.

Base portion 20, which may further provide recesses 70 and 72 for edge regions of carpets 74 and 76 (FIG. 1), is preferably, but not necessarily, extrusion molded of a strong plastic, such as urethane, PVC or styrene.

Light strip 22 comprises a thin, narrow strip 80 of heat resistant, electrically inert material such as micarta. The width, W, of strip 80 is substantially equal to above-mentioned radius, R. Strip 80 has a thickness, T, which may be about 1/32 of an inch.

Mounted through strip 80 are a number of longitudinally spaced-apart miniature lights 82. Lights 82, which may be spaced several inches apart along a centerline longitudinal axis 86 of strip 80, may advantageously comprise a "Superflux" pre-focused LED obtainable from Hewlett Packard. For example, a Hewlett Packard amber, type EPWA-DL00 having a 60° viewing angle and consuming about 147 mW may be used. Lights 82 are connected by electrical conduits 88 to a suitable power source (not shown).

Upon assembly of lighting system 10, light strip 22 is inserted in base portion 20 so that an inner edge 90 (FIGS. 3, 4A and 4B) is resting on top of rib 46 of rearward leg 36 and the other edge 92 of the strip is below rib 56 of forward portion 38. In such position, light strip can be pivoted about rib 46 through an angle "A" which is about 60° (FIG. 4B), as may be desired to provide the desired angle of illumination through opening 61.

Lens 24 is constructed from a rigid transparent or translucent plastic for being detachably attached between rib 44 at lower regions of rearward portion 36 and lower end 60 of forward wall 38. Lens 24 is formed having a small, longitudinal upper recess 94 and a corresponding lower recess 96 (FIG. 5) to enable such detachable attachment to base portion 20.. As shown in FIG. 5, lens 24 may be formed having a longitudinally grooved inner surface 98 to provide diffusion of light from lights 82. On the other hand, lens 24 may be eliminated for maximum illumination purposes.

Although there has been described and illustrated a step edge lighting apparatus in accordance with the present invention for purposes of illustrating the manner in which the invention may be used to advantage, it is to be appreciated that the invention is not limited thereto. Therefore, any and all variations and modifications that may occur to those skilled in the applicable art are to be considered as being within the scope and spirit of the claims as appended hereto.

What is claimed is:

1. An illumination apparatus for attachment to a substantially vertical surface, comprising:

a support member comprising a generally vertical wall having a rear side for mounting against said vertical surface and a front side opposite said rear side, and a projection extending transversely from an upper portion of said front side of said wall and downwardly in spaced relation to said front side, said support member including a cavity between said front side and said projection, said cavity having an opening comprised of an edge portion of said projection, said edge portion oriented so that said cavity opening is downwardly facing;

an elongate light source assembly comprising a substrate, said elongate assembly having a series of miniature lights mounted thereon, said elongate light source assembly mounted on said support member such that all of said miniature lights are disposed substantially at or above said edge portion of said downwardly facing opening, said substrate comprising a strip positioned at an acute angle with respect to said substantially vertical wall so that light from said miniature lights is directed out of said cavity opening to illuminate an area adjacent to said substantially vertical surface, whereby the miniature lights are substantially hidden from direct view when said support member is viewed in the direction of the front side.

2. The illumination apparatus of claim 1, wherein said support member additionally comprises a horizontal wall perpendicular to said vertical wall, said support member configured for mounting to an edge region of an object.

3. An illumination apparatus for attachment to a substantially vertical surface, comprising:

a support member comprising a generally vertical wall having a rear side for mounting against said vertical surface and a front side opposite said rear side, and a projection extending transversely from an upper portion of said front side of said wall and downwardly in spaced relation to said front side, said support member including a cavity between said front side and said protection, said cavity having an opening comprised of an edge portion of said projection, a diffuser extending across said opening, said edge portion oriented so that said cavity opening is downwardly facing;

an elongate light source assembly comprising a substrate, said elongate assembly having a series of miniature lights mounted thereon, said elongate light source assembly mounted on said support member such that all of said miniature lights are disposed substantially at or above said edge portion of said downwardly facing opening, whereby the miniature lights are substantially hidden from direct view when said support member is viewed in the direction of the front side.

4. The illumination apparatus of claim 3, wherein the miniature lights are spaced apart from each other and interconnected via electrical conduits.

5. The illumination apparatus of claim 2, wherein said support member is configured for mounting to an edge region of a step.

6. An illumination apparatus for attachment to a substantially vertical surface, comprising:

a support member comprising a generally vertical wall having a rear side for mounting against said vertical surface and a front side opposite said rear side, and a projection extending transversely from an upper portion of said front side of said wall and downwardly in spaced relation to said front side, said support member including a cavity between said front side and said projection, said cavity having an opening comprised of an edge portion of said projection, said edge portion oriented so that said cavity opening is downwardly facing;

an elongate light source assembly comprising a substrate, said elongate assembly having a series of miniature lights mounted thereon, said miniature lights being spaced apart from each other and interconnected via electrical conduits, and each miniature light comprises a prefocused light emitting diode which confines emitted light to a predetermined angle, said elongate light source assembly mounted on said support member such that all of said miniature lights are disposed substantially at or above said edge portion of said downwardly facing opening, whereby the miniature lights are substantially hidden from direct view when said support member is viewed in the direction of the front side.

7. An illumination apparatus for attachment to a substantially vertical surface, comprising:

a support member comprising a generally vertical wall having a rear side for mounting against said vertical surface and a front side opposite said rear side, and a projection extending transversely from an upper portion of said front side of said wall and downwardly in spaced relation to said front side, said support member including a cavity between said front side and said projection, said cavity having an opening comprised of an edge portion of said projection, said edge portion oriented so that said cavity opening is downwardly facing;

an elongate light source assembly comprising a substrate, said elongate assembly having a series of miniature lights comprised of light emitting diodes (LED's) mounted thereon, said miniature lights being prefocused to focus light from said LED's to confine the light to a predetermined angle, the prefocused LED's providing respective light beams which, when combined, illuminate a horizontal surface that extends perpendicularly from said vertical surface, said light source assembly mounted on said support member such that all of said miniature lights are disposed substantially at or above said edge portion of said downwardly facing opening, whereby the miniature lights are substantially hidden from direct view when said apparatus is viewed in the direction of the front side.

8. The illumination apparatus of claim 7, wherein said substrate comprises a strip positioned at an acute angle with respect to said substantially vertical wall so that light from said miniature lights is directed out of said cavity opening to illuminate an area adjacent to said substantially vertical surface.

9. The illumination apparatus of claim 7, wherein said support member additionally comprises a horizontal wall perpendicular to said vertical wall, said support member configured for mounting to an edge region of an object.

10. The illumination apparatus of claim 7, further comprising a diffuser extending across said opening.

11. The illumination apparatus of claim 7, wherein the miniature lights are spaced apart from each other and interconnected via electrical conduits.

12. The illumination apparatus of claim 9, wherein said support member is configured for mounting to an edge region of a step.

13. An illumination apparatus for attachment to a substantially vertical surface, comprising:

a support member comprising a generally vertical wall having a rear side for mounting against said vertical surface, a front side opposite said rear side, a horizontal wall perpendicular to said vertical wall, and a protection extending transversely from an upper portion of said front side of said wall and downwardly in spaced relation to said front side, said support member configured for mounting to an edge region of an object;

an elongate diffuser having opposite sides one of which is mounted on the projection and one of which is mounted on the front side of the wall such that the diffuser extends between the projection and the wall to form an enclosed area; and an elongated strip mounted within the enclosed area, said strip having light emitting diodes (LED's) mounted in spaced relationship along the strip, the LED's being prefocused to provide light within a predetermined angle, said prefocused LED's mounted to illuminate the diffuser and project light through the diffuser in a generally downward direction.

14. The illumination apparatus of claim 13, wherein said elongated strip is positioned at an acute angle with respect to said vertical wall so that light from said LED's is directed out of said enclosed area to illuminate an area adjacent to said substantially vertical surface.

15. The illumination apparatus of claim 13, wherein said support member is configured for mounting to an edge region of a step.

16. An elongate illumination apparatus for mounting on a flat, substantially vertical surface, comprising:

an elongate light source assembly; and an elongate light support having a cavity defined between spaced surfaces, said elongate light source assembly mounted within the cavity between elongate ribs extending from said spaced surfaces, respectively, the light support further including a cavity opening having a top edge, said cavity opening in optical communication with the cavity;

said elongate light source assembly comprising a series of miniature lights, each miniature light mounted on a substrate and comprising a light emitting diode (LED), the miniature lights being prefocused to focus light from the LED's to confine the light to a predetermined angle, the prefocused LED's providing respective light beams which, when combined, illuminate an area adjacent to the vertical surface, the substrate being substantially flat and positioned at an acute angle relative to the vertical surface, the substrate having opposing first and second edges which are adapted to engage the ribs on the light support, said cavity opening configured so that said miniature lights are disposed substantially at or above the top edge of the cavity opening;

whereby the miniature lights are substantially hidden from direct view when the apparatus is viewed in the direction of a front side.

17. The apparatus of claim 16, comprising a diffuser positioned across the cavity opening.

18. The apparatus of claim 16, wherein the top edge is oriented so that the cavity opening is downwardly facing.

* * * * *

UNITED STATES PATENT AND TRADEMARK OFFICE

CERTIFICATE OF CORRECTION

PATENT NO. : 6,082,870
DATED : July 4, 2000
INVENTOR(S) : Ben B. George

It is certified that error appears in the above-identified patent and that said Letters Patent is hereby corrected as shown below:

Column 4,
Line 28, "protection" should be -- projection --

Signed and Sealed this

Twenty-sixth Day of March, 2002

*Attest:*

*Attesting Officer*

JAMES E. ROGAN
*Director of the United States Patent and Trademark Office*